United States Patent [19]

Herron

[11] 4,161,152

[45] Jul. 17, 1979

[54] PRETENSION THREADING DEVICE

[75] Inventor: William L. Herron, Elizabeth, N.J.

[73] Assignee: The Singer Company, New York, N.Y.

[21] Appl. No.: 950,654

[22] Filed: Oct. 12, 1978

[51] Int. Cl.[2] ..... D05B 47/00

[52] U.S. Cl. ..... 112/254; 112/259

[58] Field of Search ..... 112/254, 259

[56] References Cited

U.S. PATENT DOCUMENTS

| | | | |
|---|---|---|---|
| 2,554,895 | 5/1951 | Robert | 112/254 |
| 2,756,704 | 7/1956 | Lawber | 112/254 |
| 3,954,073 | 5/1976 | Varin | 112/259 |
| 3,970,019 | 7/1976 | Coulombe et al. | 112/254 X |
| 3,972,298 | 8/1976 | Berman et al. | 112/254 |

*Primary Examiner*—Werner H. Schroeder
*Assistant Examiner*—Andrew M. Falik
*Attorney, Agent, or Firm*—Michael H. Wallach; Robert E. Smith; Edward L. Bell

[57] ABSTRACT

A threading device facilitating threading of a pretension device located on the rear surface of the bracket arm of a sewing machine. The threading device has a segment projecting beyond a rear corner of the arm to facilitate introduction of thread by an operator seated in front of the machine. An ear and fin member guide the thread from the point of thread introduction into engagement with the pretension device, and preclude the thread from becoming unthreaded.

1 Claim, 2 Drawing Figures

PRETENSION THREADING DEVICE

BACKGROUND OF THE INVENTION

1. Field of the Invention

This invention relates to a means for accurately threading a thread pretension device located in a position on a sewing machine not readily observable by a sewing machine operator, and with a minimum degree of operator attention and care.

2. Description of the Prior Art

Sewing machines have several thread handling instrumentalties which must each be properly threaded in the correct order to insure optimum sewing performance. A desirable objective of sewing machine designers is the elimination of as many unneeded thread handling instrumentalties as possible and the simplified threading of those which can not be eliminated. The thread pretension device which controls the thread removed from a thread supply spool is but one example of a thread handling instrumentality which must be properly threaded for a sewing machine to operate correctly.

One problem with existing thread pretension devices is that they must be threaded properly to insure correct operation.

Another problem is that the pretension device is often visually obscured from the operator by other sewing machine components.

Still another problem is that a thread guide must be placed intermediate the pretension device and the thread supply to preclude the thread from working its way out of the pretension.

SUMMARY OF THE INVENTION

It is an object of this invention to provide a sewing machine pretension device that is easily threaded.

It is another object to provide a pretension device which does not require a thread guide between it and the supply of thread.

Still another object is to produce a pretension device which will not be susceptible to becomming unthreaded by thread motion about the pretension.

The above objects and other advantages are achieved by a pretension threading device which forms an extension of the pretension device mounting bracket and an elongated, tapered ear which is fastened to the rear surface of the sewing machine arm and which extends away from the pretension. The ear forms a catching means for trapping thread fed from the supply spool toward the pretension device, and is spaced apart from the rear surface of the arm to permit thread from the supply spool to be introduced therebetween. A fin member overlies the pretension device in covering relation and extends away from the pretension toward a rear vertical corner of the arm. The fin member has depending therefrom a tapered lip which deflects thread drawn between the ear and the arm toward the thread engaging portion of the pretension, thereby positively locating thread from the thread supply in the pretension without undue operator intervention.

DESCRIPTION OF THE DRAWINGS

The above and other objects of this invention will become evident from a full and complete understanding of a preferred embodiment which is hereinafter set forth in such detail as to enable those skilled in the art to readily understand the function, operation, construction and advantages of it when read in conjunction with the accompanying drawings in which.

DESCRIPTION OF THE PREFERRED EMBODIMENT

Figure 1:
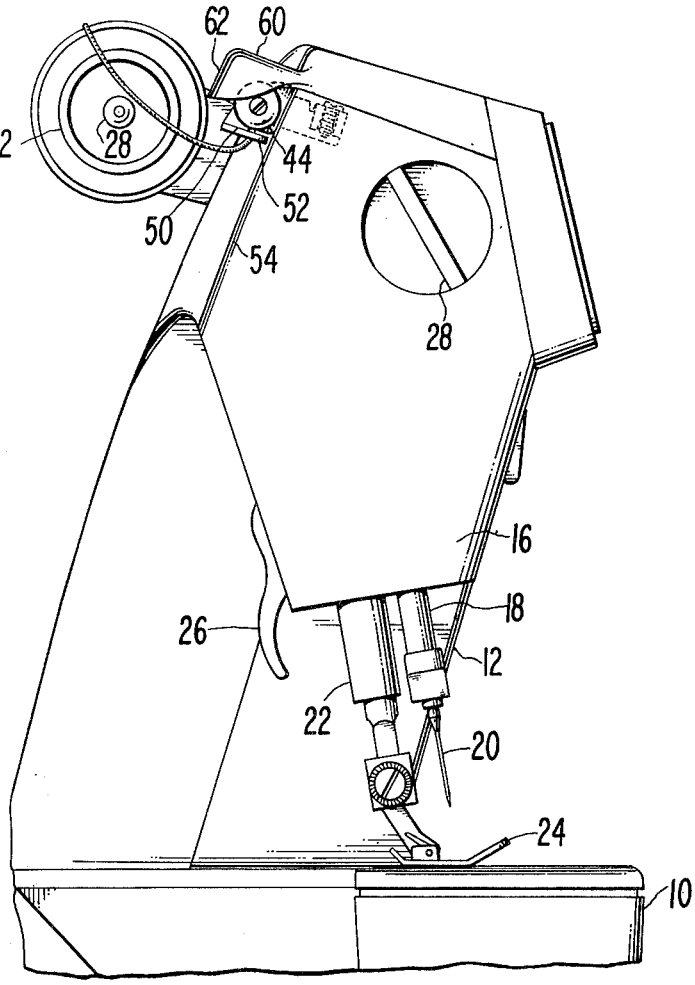
FIG. 1 is an end plan view of a sewing machine having a preferred embodiment of this invention attached thereto.

Referring to the drawings, FIG. 1 shows an end view of a sewing machine having a base 10 from which rises a standard 12 which supports a bracket arm 14. The bracket arm 14 overhangs the base 10 and terminates in a sewing head 16 in which is journalled a needle bar 18 for endwise reciprocatory motion toward and away from the base 10. The needle bar 18 has fastened thereto a needle 20. A presser bar 22 having a presser foot 24 fastened thereto is also journalled in the sewing head 16 and may be moved toward and away from contact with the base 10 by manipulation of a presser bar lifter lever 26. A control 28 is provided to permit adjustment of the pressure applied to the material being sewn by the presser foot 24.

Figure 2:
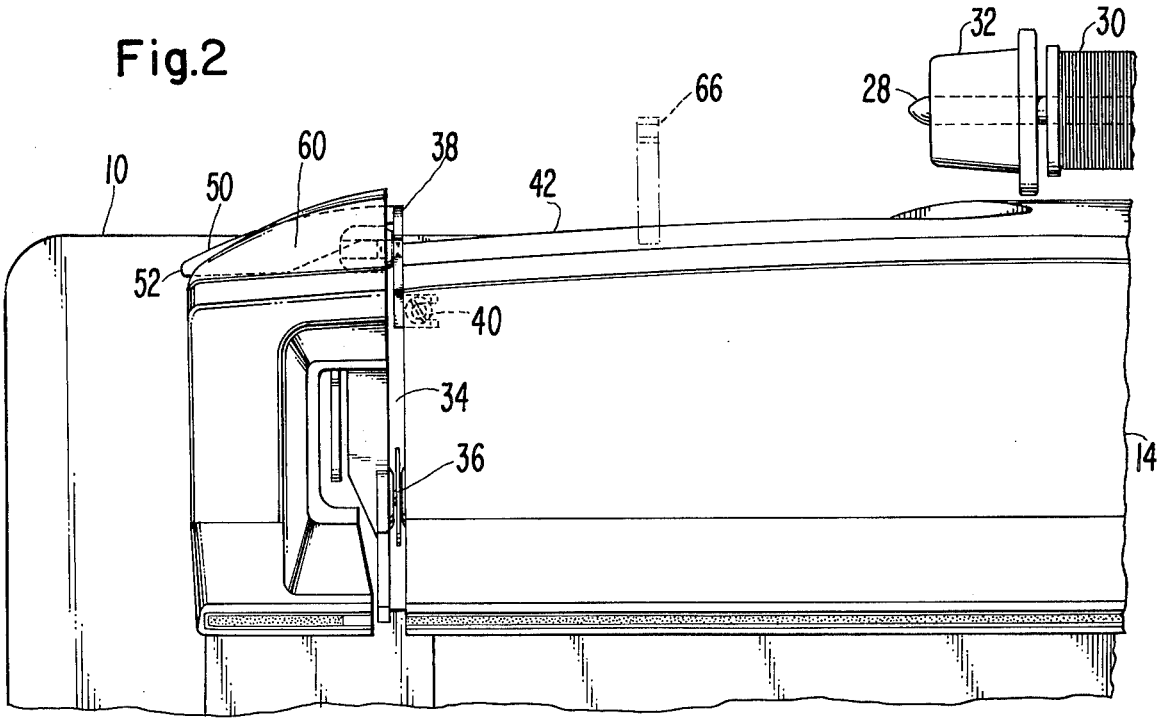
FIG. 2 is a top plan view of the portion of the sewing machine arm to which the pretension is attached and showing in phantom a thread guide which is obviated as a result of the invention.

FIG. 2 shows a spool pin 28 which is fastened to a rear surface 42 of the bracket arm 14 on which a spool of sewing thread 30 may be carried. A retainer 32 may preferably hold the spool 30 to the pin 28.

The bracket arm 14 has a slot 34 passing therethrough in which is fastened a needle thread tension device 36 comprising a pair of spaced discs which impart a frictional drag to movement of a thread passing therebetween.

Figure 3:
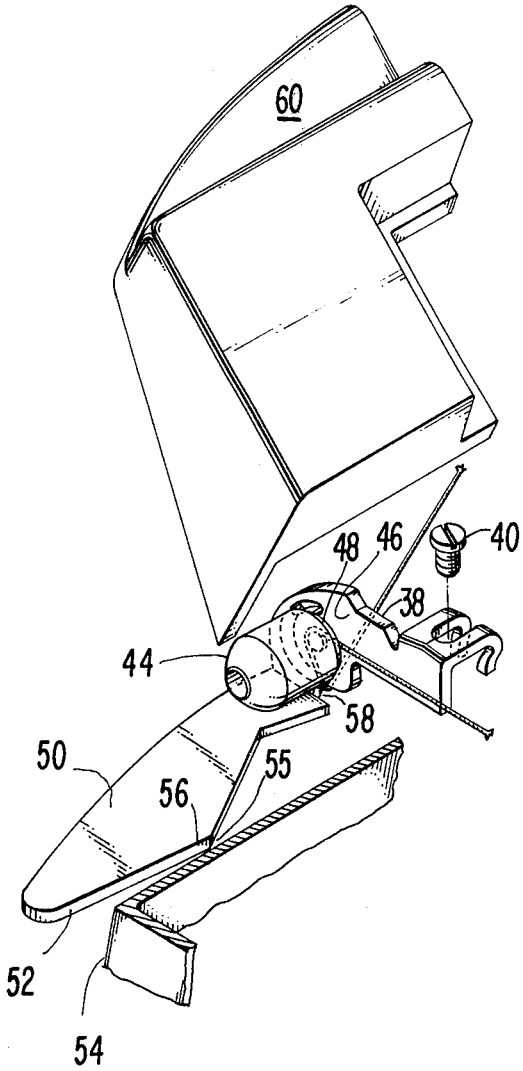
FIG. 3 is a perspective view of a pretension threading device with the thread deflecting fin removed to show an elongated ear with a properly threaded pretension device attached thereto.

A support bracket, shown at 38 in FIG. 3, is fastened to the arm 14 by a screw 40. The support bracket 38 extends beyond the rear surface 42 of the bracket arm 14 and has fastened thereto a pretension device 44. A thread engaging passageway is formed by a vertical surface 46 of the support bracket 38 and the pretension 44, the thread being passed between a convex spring loaded disc 48 of the pretension 44 and the surface 46.

The support bracket 38 is formed with an elongated ear 50 which extends beneath the pretension device 44 and along the rear surface 42 of the bracket arm 14. The ear 50 extends in a direction away from the thread spool 30 and tapers at its free extremity. A segment 52 of the ear 50 projects beyond a rear corner 54 of the bracket arm 14. The segment 52 is spaced away from the rear surface 42 of the bracket arm 14, permitting a thread to be drawn therebetween.

Figure 4:
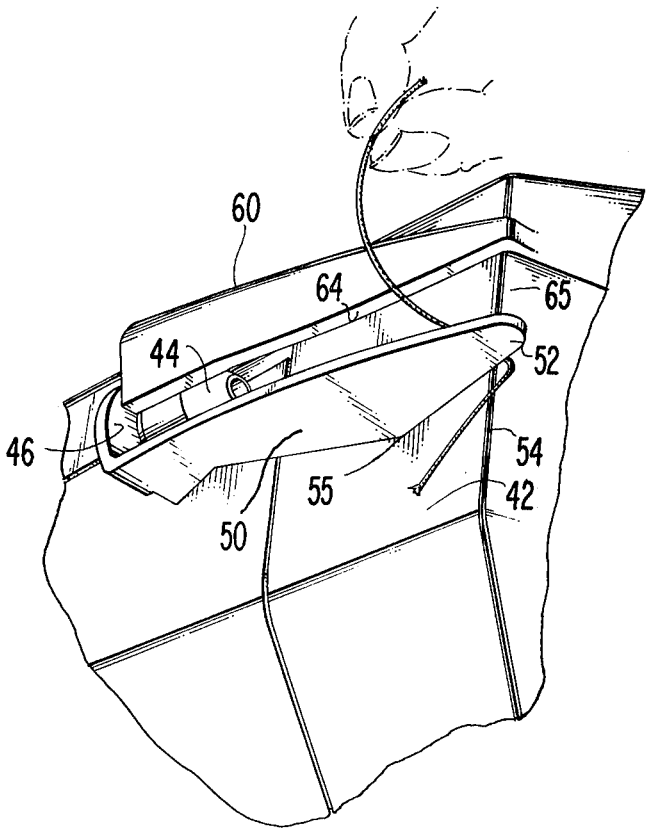
FIG. 4 is a bottom perspective view of a pretension threading device showing how the tapered lip of the fin directs a thread that has been drawn between the elongated ear and the rear surface of the sewing machine arm toward the thread engaging portion of the pretension device.

FIGS. 3 and 4 show that the segment 52 preferably acts as a thread catching point from which thread can be directed into a notch 55 between the ear 50 and the rear surface 42. The ear 50 also has a tapered edge 56 which terminates in a thread holding notch 58 located beneath the pretension device 44 so that thread drawn along the edge 56 will enter the notch 58 when it is drawn toward the pretension device 44.

Preferably a horizontal fin 60 is fastened to the bracket arm 14 so that it extends in covering relation from the corner 54 to the pretension 44 and terminates at the slot 34, tapering away from the pretension 44 toward its intersection with the corner 54. The fin has a lip 62 with an edge 64 depending therefrom which overhangs and partially encloses the pretension 44 and which tapers upwardly therefrom toward the fin 60, to form an increasingly expansive slot 65 between the elongated ear 50 and the lip 62 toward the corner 54.

In operation, a length of thread is drawn off the spool 30 and under the segment 52 of the ear 50 as is shown in FIG. 4. The thread is then drawn upward and toward the pretension 44 so that it engages the edge 64 of the lip 62. As the thread is drawn toward the pretension 44 it is guided toward the notch 55 by the ear 50 and the lip 62 of the fin 60. After passing through the notch 55 the thread is drawn along the edge 56 until it enters the thread holding notch 58. The thread enters the pretension 44 between the disc 48 and the vertical surface 46 when it is drawn through the slot 34 in the arm 14. The thread is precluded from disengagement with the pretension 44 as a result of the distance of the notch 55 from the position of engagement of the thread with the pretension 44 and the vertical surface 46. Ease of threading is assured by the extension of the segment 52 beyond the corner 54, which permits an operator to observe the point of engagement of the thread with the threading device even while seated in front of the sewing machine. Proper positioning of the thread in the pretension device 44 is assured by the cooperation of the fin 60 with the lip 62 and the elongated ear 50 in directing the thread to the pretension device 44. A thread guide 66 heretofore required to insure a proper lead from the supply 30 to the pretension device 44 is shown in phantom in FIG. 2 interposed between the thread supply 30 and the pretension device 44. The need for the thread guide 66 is eliminated as a result of the pretension threading device disclosed herein, since the extended length of the ear 50 and the fin member 60 preclude thread from becoming unwrapped from the pretension device 44. FIG. 4 also shows that misthreading of the pretension 44 is precluded since thread drawn from the supply spool must be led into the expansive slot 65 between the ear 50 and the lip 62 which provide a definite guide for proper engagement of the thread around the pretension 44.

It will be appreciated that modifications and variations of the described invention may become evident to one skilled in the art in light of the above teachings. However, it is to be understood that the present disclosure relates to but one preferred embodiment which is for the purpose of illustration only, and not to be construed as a limitation of the invention. All such modifications which do not depart from the spirit of the invention are intended to be included within the scope of the appended claims.

I claim:

1. A pretension threading device facilitating threading of a pretension device of a sewing machine having a base and a bracket arm with a rear surface and a rear corner at one extremity of said arm, said arm overhanging said base and supporting a thread supply for supplying thread to said pretension device, said pretension threading device comprising an elongated ear fastened to said bracket arm and extending away from said thread supply along the rear surface of said arm and having a segment projecting beyond the rear corner of said arm, said ear having said pretension device attached thereto and having a thread holding notch for engaging thread from said thread supply against said pretension device, said ear also having an edge for guiding thread from said projecting segment to said thread holding notch, and a fin disposed in covering relation about said pretension device, said fin tapering away from said thread supply toward said rear corner of said arm, and a lip depending from said fin, said lip tapering toward said rear corner of said arm to form an expansive slot between said fin and said ear at said rear corner, said lip guiding a length of thread drawn under said segment of said ear projecting beyond said rear corner and between said arm and said ear toward said thread holding notch and said pretension device.

* * * * *